US005284033A

United States Patent [19]

Lonati et al.

[11] Patent Number: 5,284,033

[45] Date of Patent: Feb. 8, 1994

[54] SINGLE-CYLINDER CIRCULAR KNITTING MACHINE WITH ANTI-TWIST DEVICE, IN PARTICULAR FOR MANUFACTURING SOCKS AND STOCKINGS

[75] Inventors: Francesco Lonati; Tiberio Lonati; Ettore Lonati; Fausto Lonati, all of Brescia, Italy

[73] Assignee: Lonati S.r.l., Monza, Italy

[21] Appl. No.: 846,507

[22] Filed: Mar. 6, 1992

[30] Foreign Application Priority Data

Mar. 14, 1991 [IT] Italy ..... MI91A-000691
Dec. 5, 1991 [IT] Italy ..... MI91A-003258

[51] Int. Cl.[5] ..... D04B 15/92
[52] U.S. Cl. ..... 66/149 S; 66/150
[58] Field of Search ..... 66/149 S, 150, 151, 66/152, 153, 149 R

[56] References Cited

U.S. PATENT DOCUMENTS

| | | | |
|---|---|---|---|
| 3,516,268 | 6/1970 | Foreman | 66/149 S |
| 4,242,891 | 1/1981 | Gradi | 66/149 S |
| 4,287,729 | 9/1981 | Manini nee Gallichi | 66/149 S |
| 4,339,932 | 7/1982 | Lonati | 66/149 X |

FOREIGN PATENT DOCUMENTS

| | | | |
|---|---|---|---|
| 329625 | 8/1989 | European Pat. Off. | 66/149 S |
| 2044432 | 9/1970 | Fed. Rep. of Germany | 66/149 S |
| 7017122 | 5/1972 | Netherlands | 66/149 S |
| 957507 | 5/1964 | United Kingdom . | |
| 1055701 | 7/1967 | United Kingdom . | |
| 2124260 | 2/1984 | United Kingdom . | |
| 2133049 | 7/1984 | United Kingdom . | |

*Primary Examiner*—Peter Nerbun
*Assistant Examiner*—Larry D. Worrell, Jr.
*Attorney, Agent, or Firm*—Guido Modiano; Albert Josif

[57] ABSTRACT

A single-cylinder circular knitting machine with anti-twist device includes a needle cylinder in which there is a cavity which is open upward and can be connected, through a perforated region which extends around the needle cylinder axis, to a suction device so as to retain the product during its forming against the walls of the cavity. An inner tubular body is arranged inside the cavity and can be connected to a suction device for drawing the finished product through the inner tubular body. The inner tubular body is controllably movable along an axial direction from a first position, in which its upper end is proximate to the upper end of the needle cylinder, to a second position, in which its upper end is proximate to the bottom of the cavity.

15 Claims, 5 Drawing Sheets

6
64
6a
41
34
39
32
15
17

6
6a
41
14
15
32
64
34
39
17
1

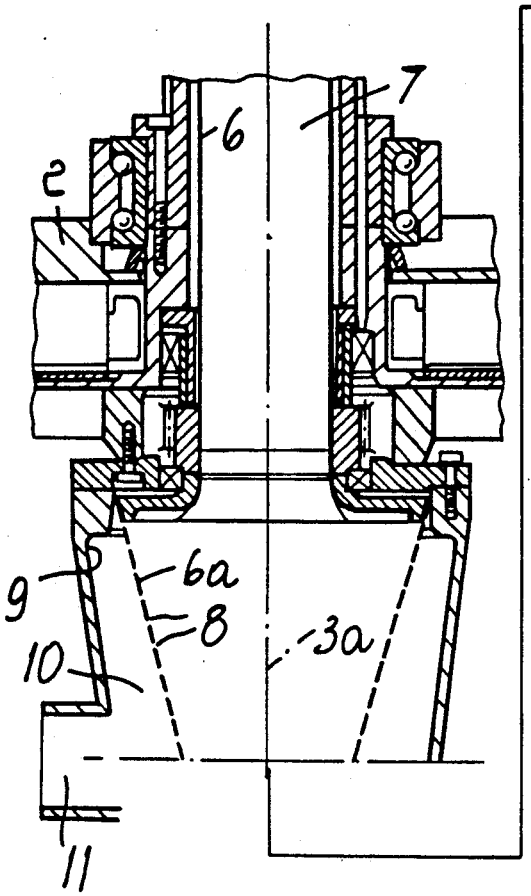
Fig. 10
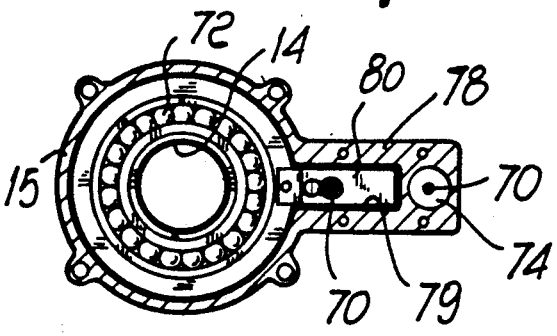
Fig. 11
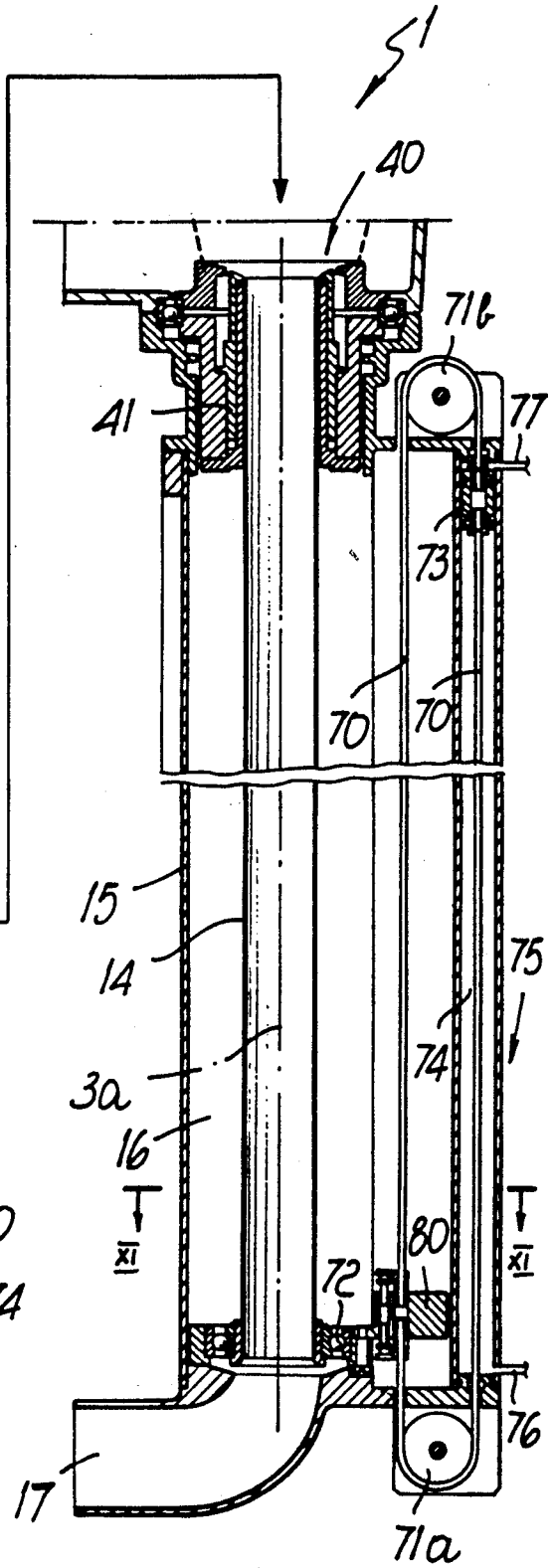

SINGLE-CYLINDER CIRCULAR KNITTING MACHINE WITH ANTI-TWIST DEVICE, IN PARTICULAR FOR MANUFACTURING SOCKS AND STOCKINGS

BACKGROUND OF THE INVENTION

The present invention relates to a single-cylinder circular knitting machine with anti-twist device, in particular for manufacturing socks or stockings.

As is known, single-cylinder circular knitting machines for manufacturing socks or stockings are generally provided with a device termed "anti-twist" which during the manufacture of the product prevents said product from becoming twisted due to the rotation of the needle cylinder about its own axis.

More particularly, the needle cylinder is provided with an axial through cavity which is extended downward by an outer tube. The terminal lower part of said tube is perforated, and a chamber is defined around it; said chamber can be connected to a suction device so as to generate a suction along the cavity of the needle cylinder which subjects the product to tension during its manufacture and makes it adhere to the perforated region of the outer tube. The adhesion of the product to the outer tube, which rotates together with the needle cylinder, avoids the twisting of the product itself and, at the same time, causes an accumulation of the product between the upper end of the needle cylinder and the perforated region which is particularly useful in the case of products having a considerable length, such as for example ladies, stockings.

Furthermore, a coaxial inner tube is arranged in the outer tube and is arranged so that its upper end is at the upper end of the needle cylinder, i.e. proximate to the needle working region. When the manufacture of the product is complete, said inner tube is connected to a suction device and the suction in the outer tube is interrupted so that the product progressively rises along the interspace defined between the outer tube and the inner tube and is automatically extracted from the machine, passing through the inner tube. The transfer from the outside toward the inside of the inner tube, entering from its upper end, also automatically turns the product inside out, as required in order to perform subsequent operations, such as for example the closing of the toe of the product.

Said known types of machine with anti-twist device have some problems.

In fact, in the case of products manufactured with particular types of thread, the raising operation of the sock or stocking along the inner tube can be difficult. In order to avoid this problem, in many cases pressurized air is fed through the perforated region of the outer tube so as to aid the aspiration of the product along the inner tube.

However, this solution entails the use of a more complicated pneumatic circuit, and the pressure of the air fed into the outer tube must be adjusted according to the type of thread used in manufacturing the product. It is furthermore necessary to use relatively high-power suction devices.

Another problem which can be observed in known machines is the difficulty in eliminating any production rejects which arrange themselves between the outer tube and the inner tube. In many cases, the suction applied to the inner tube is sufficient to remove the production reject, whereas in other cases the suction is ineffective, with the problem that the unremoved reject partially or totally closes the holes of the outer tube, causing malfunction of the anti-twist device during the manufacture of successive products. In this case, it is necessary to stop the machine and intervene manually with considerable difficulties, due to the length of the needle cylinder and to the small dimensions of the interspace between the outer tube and the inner tube.

Furthermore, with known machines, when the product does not have to be turned inside out at the end of manufacture, it is necessary to intervene manually in order to remove the inner tube.

SUMMARY OF THE INVENTION

The aim of the present invention is to obviate the problems described above by providing a single-cylinder machine with anti-twist device which ensures that the product is turned inside out and that it is removed from the machine at the end of its manufacture even in the case of products which tend to adhere to the outer surface of the inner tube.

Within the scope of this aim, an object of the invention is to provide a machine wherein the anti-twist device can be actuated correctly even with a reduced suction power.

Another object of the invention is to provide a machine wherein the removal of the product is ensured even in the case of particular products having a particularly rigid elastic border.

A further object of the invention is to provide a machine wherein it is possible to disable the turning of the product inside out without performing disassembly interventions on the anti-twist device.

Yet another object of the invention is to provide a machine which ensures the discharge of defective products which even have small dimensions.

This aim, these objects and others which will become apparent hereinafter are achieved by a single-cylinder circular machine with anti-twist device, in particular for manufacturing socks and stockings, comprising a needle cylinder which is rotatable about its own axis and which supports a plurality of needles proximate to its upper end, a cavity being defined substantially coaxially in said needle cylinder, said cavity being open at the upper end of the needle cylinder and being connectable, through a perforated region which extends around the axis of the needle cylinder and is spaced downward from the upper end of the needle cylinder, to a suction device for retaining the product being formed against the walls of said cavity, an inner tubular body being provided, said inner tubular body being accommodated in said cavity substantially coaxially to the needle cylinder and being controllably connectable to a suction device to aspirate the finished product through said inner tubular body, characterized in that said inner tubular body is controllably axially movable along said cavity from a first position, in which its upper end is proximate to the upper end of the needle cylinder, to a second position, in which its upper end is spaced from the upper end of the needle cylinder in the direction of said perforated region, and vice versa.

Further characteristics and advantages of the invention will become apparent from the description of a preferred but not exclusive embodiment of the machine according to the invention, illustrated only by way of non-limitative example in the accompanying drawings, wherein:

BRIEF DESCRIPTION OF THE DRAWINGS

FIG. 10 is an axially sectional schematic view of the machine according to a further aspect of the present invention showing a variation in the actuation means for the inner tubular body; and FIG. 11 is a schematic sectional view taken along the plane XI—XI of FIG. 10.

DESCRIPTION OF THE PREFERRED EMBODIMENTS

Figure 1:
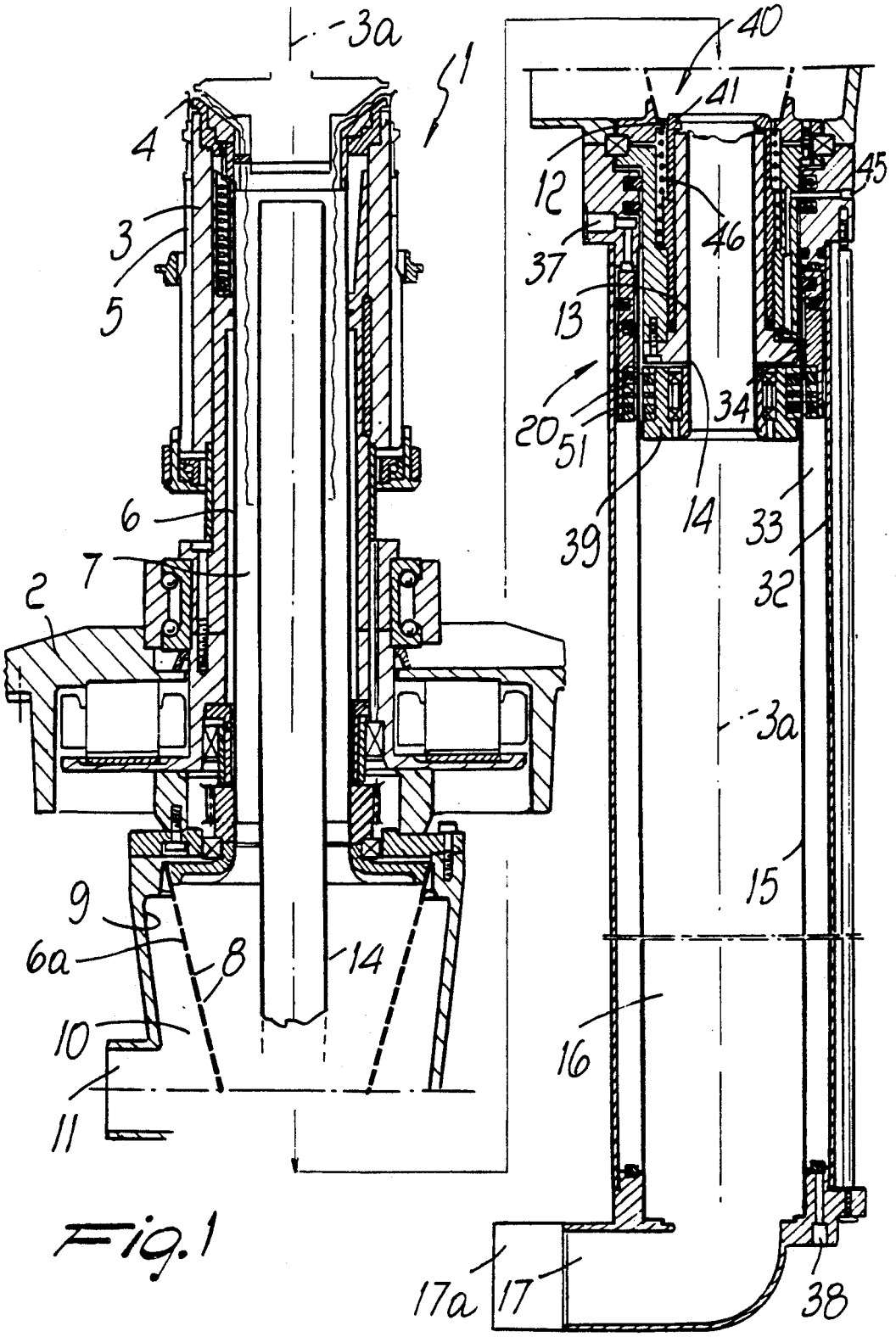
FIG. 1 is an axially sectional schematic view of the machine according to the invention.
Figure 2:
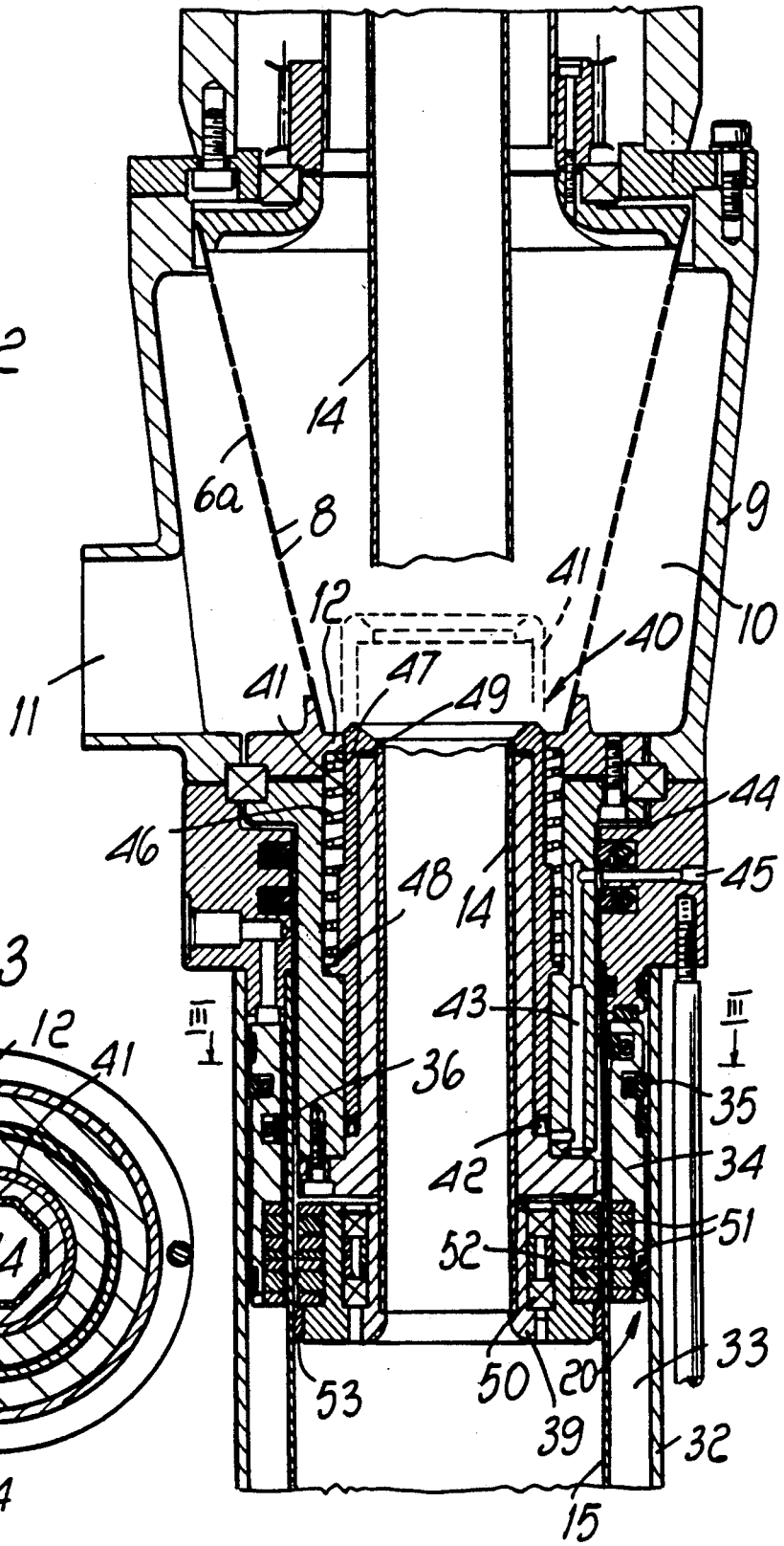
FIG. 2 is an enlarged view of a detail of FIG. 1.

With reference to the above figures, the machine according to the invention, generally designated by the reference numeral 1, comprises a supporting structure 2 which rotatably supports a vertically arranged needle cylinder 3 so that it can rotate about its own axis 3*a*.

The needle cylinder 3 supports, proximate to its upper end, a plurality of needles 4 which are slidably accommodated, in a known manner, in axial grooves 5 defined in the outer skirt of the needle cylinder 3.

Said needle cylinder 3 is internally hollow and an outer tubular body 6 is applied to its inner surface; said body 6 is coaxial to, and rigidly associated with, the needle cylinder in rotation about the axis 3*a* thereof. The outer tubular body 6 internally defines a cavity 7 which is open upward at the upper end of the needle cylinder 3 near the needles 4.

The tubular body 6 has an extension which is arranged below the needle cylinder 3 with a frustum-shaped portion 6*a* which has its larger planar face directed toward the upper end of the needle cylinder, and which is crossed by a plurality of holes 8. Said portion 6*a* is surrounded by a substantially cylindrical jacket 9 which is arranged coaxially to the needle cylinder 3 and is fixed to the supporting structure 2 so that an annular chamber 10 is defined between the tubular body 6 and the jacket 9 which can be connected, through a port 11, to a known suction device which is not illustrated for the sake of simplicity. The outer tubular body 6 thus defined constitutes the anti-twist device of the machine, as will become apparent hereinafter.

The lower end of the outer tubular body 6 is closed by a bottom 12 which is axially crossed by a seat 13 through which is slidably accommodated an inner tubular body 14 which is coaxial to the outer tubular body 6.

According to the invention, the inner tubular body 14 is controllably movable axially along the cavity 7 from a first position, wherein its upper end or tubular body upper end is proximate to the upper end of the needle cylinder, to a second position, wherein its upper end is spaced from the upper end of the needle cylinder toward the perforated portion 6*a* of the outer tubular body 6.

Figure 3:
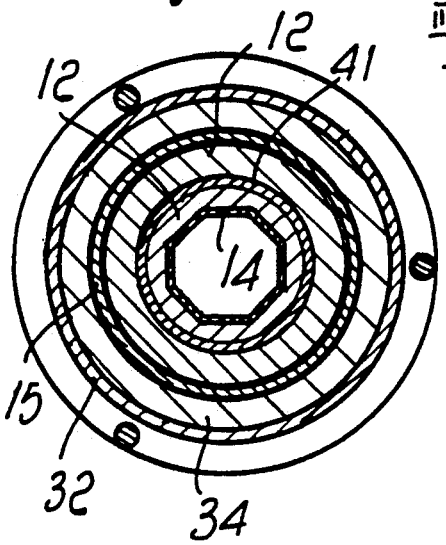
FIG. 3 is a schematic sectional view of FIG. 2, taken along the plane III—III.

The inner tubular body 14 can slide along the seat 13 and is rigidly associated with the outer tubular body 6 in rotating about the axis 3*a*. Rotational connection is preferably obtained by shaping the outer surface of the inner tubular body 14 according to a polygonal profile and by correspondingly shaping the seat 13 of the bottom 12 in which the inner tubular body 14 can slide axially (FIG. 3).

Advantageously, as illustrated in particular in FIG. 1, a chamber 16 is defined below the outer tubular body 6 by means of a hollow cylindrical body 15 which is fixed to the supporting structure 2; said chamber 16 can be connected through a port 17 to a known suction device 17*a*. The hollow cylindrical body 15 is arranged coaxially to the needle cylinder 3, and its length is such as to contain the inner tubular body 14 in the second position.

Advantageously, when the inner tubular body 14 is in the second position, its upper end is arranged at the upper wall of the bottom 12.

Auxiliary means, generally designated by the reference numeral 40, are conveniently provided and can be controllably actuated in order to facilitate the disengagement of the product from the inner tubular body 14 in the second position, as will become apparent hereinafter.

Said auxiliary means 40 comprise an auxiliary tubular body 41 which is arranged coaxially around the inner tubular body 14 and is accommodated, so as to be able to slide along the axis 3*a*, in the bottom 12 of the outer tubular body 6.

More particularly, the auxiliary tubular body 41 is provided as a hollow piston which can slide along an annular chamber 42 which is defined inside the bottom 12 and which can be connected, through a duct 43 which extends within the bottom 12, to a source of pressurized fluid. Said duct 43 is connected to the lower end of the chamber 42 and to an annular groove 44 which is defined between the bottom 12 and the supporting structure 2 of the machine and is connected to a feed duct 45 defined in the supporting structure 2 so as to allow to connect the chamber 42 to a source of pressurized fluid despite the rotation of the bottom 12 and of the outer tubular body 6 about the axis 3*a* with respect to the supporting structure 2.

A spring 46 is accommodated inside the bottom 12 and is interposed between a shoulder 47 defined by the bottom 12 and a shoulder 48 of the auxiliary tubular body 41 so as to elastically contrast the movement of the auxiliary tubular body 41 in the direction towards the upper end of the needle cylinder.

The upper edge of the auxiliary tubular body 41 has an inward radial expansion 49 which slidingly makes contact with the outer surface of the inner body 14.

By connecting the feed duct 45 to a pressurized fluid source, the auxiliary tubular body 41 passes from an inoperative position, wherein its upper edge is arranged substantially at the level of the upper wall of the bottom of the outer tubular body 6, to an operative position wherein its upper edge is arranged above the upper edge of the inner tubular body 14 in its second position.

The passage of the auxiliary tubular body 41 from the inoperative position to the operative position is contrasted elastically by the spring 46, which returns the auxiliary tubular body 41 into the inoperative position as soon as the connection of the annular chamber 42 to the pressurized fluid source is interrupted.

Actuation means 20 are conveniently provided for axially moving the inner tubular body 14.

Said actuation means can be controlled by a control element which supervises the operation of the entire machine, and are preferably constituted by a pneumatic actuator which is magnetically connected to the lower end of the inner tubular body 14.

More particularly, another hollow cylindrical body 32 is arranged coaxially around the hollow cylindrical body 15 and, like the hollow cylindrical body 15, is rigidly fixed to the supporting structure 2 of the machine. A chamber 33 having an annular cross-section is defined between the hollow cylindrical body 32 and the hollow cylindrical body 15 and accommodates, so that it can slide axially, a perforated piston 34 which is sealingly coupled by means of gaskets 35 and 36 both to the outer surface of the hollow cylindrical body 15 and to the inner surface of the hollow cylindrical body 32. The chamber 33 can be connected, through ports 37 and 38 defined respectively proximate to the axial ends of the hollow cylindrical body 32, to a source of pressurized air or to the atmosphere so as to cause the axial movement of the perforated piston 34 in one direction or in the other.

An annular slider 39 is arranged in the hollow cylindrical body 15 and is associated with the lower end of the inner tubular body 14 with a bearing 50 interposed.

The perforated piston 34 is provided with inserts 51 made of magnetic material which interact with inserts 52 which are associated with the annular slider 39 and are constituted by a material which is subject to magnetic attraction or by permanent magnets. In this manner, an axial movement of the perforated piston 34 causes the axial movement of the annular slider 39 and thus of the inner tubular body 14.

The hollow cylindrical body 15 and the hollow cylindrical body 32 are made of non-magnetic material, so as not to interfere with the magnetic interaction which occurs between the perforated piston 34 and the annular slider 39.

The chamber 3 is sealingly separated from the hollow cylindrical body 15, which is connected to the inside of the tubular body 14.

For the sake of completeness in description, it should be noted that the annular slider 39 is provided, on its outer surface, with a gasket 53 which makes sliding contact with the inner surface of the hollow cylindrical body 15.

As illustrated in FIGS. 10 and 11, the actuation means for moving the inner tubular body 14 from the first to the second position and vice versa can comprise an elongated flexible element 70, for example a cable, rope or other technically equivalent element, closed upon itself and wrapped about two return pulleys 71*a* and 71*b* which are arranged below and laterally of the needle cylinder such that the two branches of the elongated flexible element 70 extend between the two pulleys 71*a* and 71*b* in a direction parallel to the axis of the needle cylinder.

One of the two branches of the flexible element 70 is fixed, with the interposition of a bearing 72, to the lower end of the inner tubular body 14, while the other branch constitutes a stem of a piston 73 which is slidable inside a cylindrical chamber 74 of a two-way fluid-actuated cylinder 75.

The cylindrical chamber 74 is connectable, through ports 76 and 77 arranged at opposite ends with respect to the piston 73, with a pressurized fluid source or with a discharge outlet so as to perform the translation of the piston along the cylindrical chamber 74 which is parallel to the inner tubular body 14. The translation of the piston 73 in one direction or in the other provokes the longitudinal movement of the elongated element 70 and a corresponding movement of the inner tubular body 14 from the first position to the second position and vice versa.

As illustrated particularly in FIG. 11, the hollow cylindrical body 15 can be provided with a lateral protrusion 78 in which the cylindrical chamber 74 is internally defined, sealingly separated from the remaining part of the hollow cylindrical body 15. A guide 79 is furthermore defined in the protrusion 78 along which a block 80 slides which connects the elongated element 70 to the lower end of the inner tubular body 14.

The operation of the machine with anti-twist device according to the invention is as follows.

At the beginning of the manufacture of the product 64, the inner tubular body 14 is in the first position and the port 11 is connected to the suction device, which generates a flow of air from the upper end of the needle cylinder 3 along the cavity 7 and through the holes 8 from the inside outward.

By virtue of this flow of air, the product 64 is subjected to tension in a downward direction.

When the product 64 reaches the perforated region 6*a*, due to the suction applied, it adheres to the inner surface of the outer tubular body 6 which constitutes the inner wall of the cavity 7. In this manner, the product rotates rigidly together with the outer tubular body 6 and its twisting around the axis 3*a* during manufacture is thus avoided (FIG. 4).

During manufacture, the product 64 accumulates between the outer tubular body 6 and the inner tubular body 14. It should be noted that in this step the particular frustum-shaped portion 6*a* of the outer tubular body 6 allows to obtain an adequate tension of the product even in case of products having a considerable length.

Just before the manufacture of the product 64 ends, the connection of the port 11 to the suction device is disabled and the suction device is instead connected to the port 17 so as to generate suction along the tubular body 14, whose upper end is proximate to the upper end of the needle cylinder 3, i.e. proximate to the work area of the needles 4. In this manner, when manufacture ends, the upper end of the product 64 is drawn inside the inner tubular body 14 (FIG. 5).

Figures 4, 5, 6:
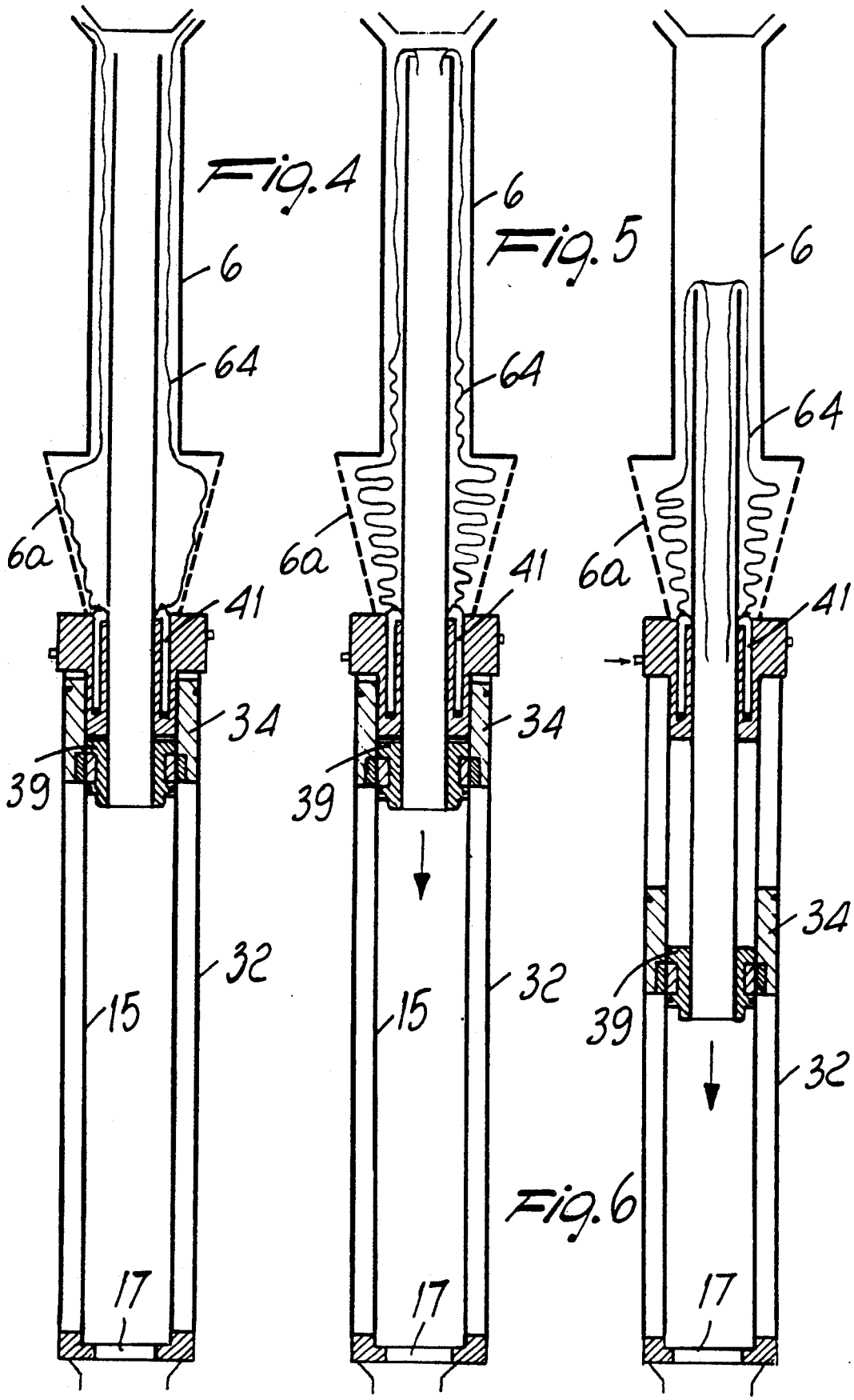
FIGS. 4 to 8 are schematic views of the operation of the anti-twist device of the machine according to the invention.
Figures 7, 8, 9:
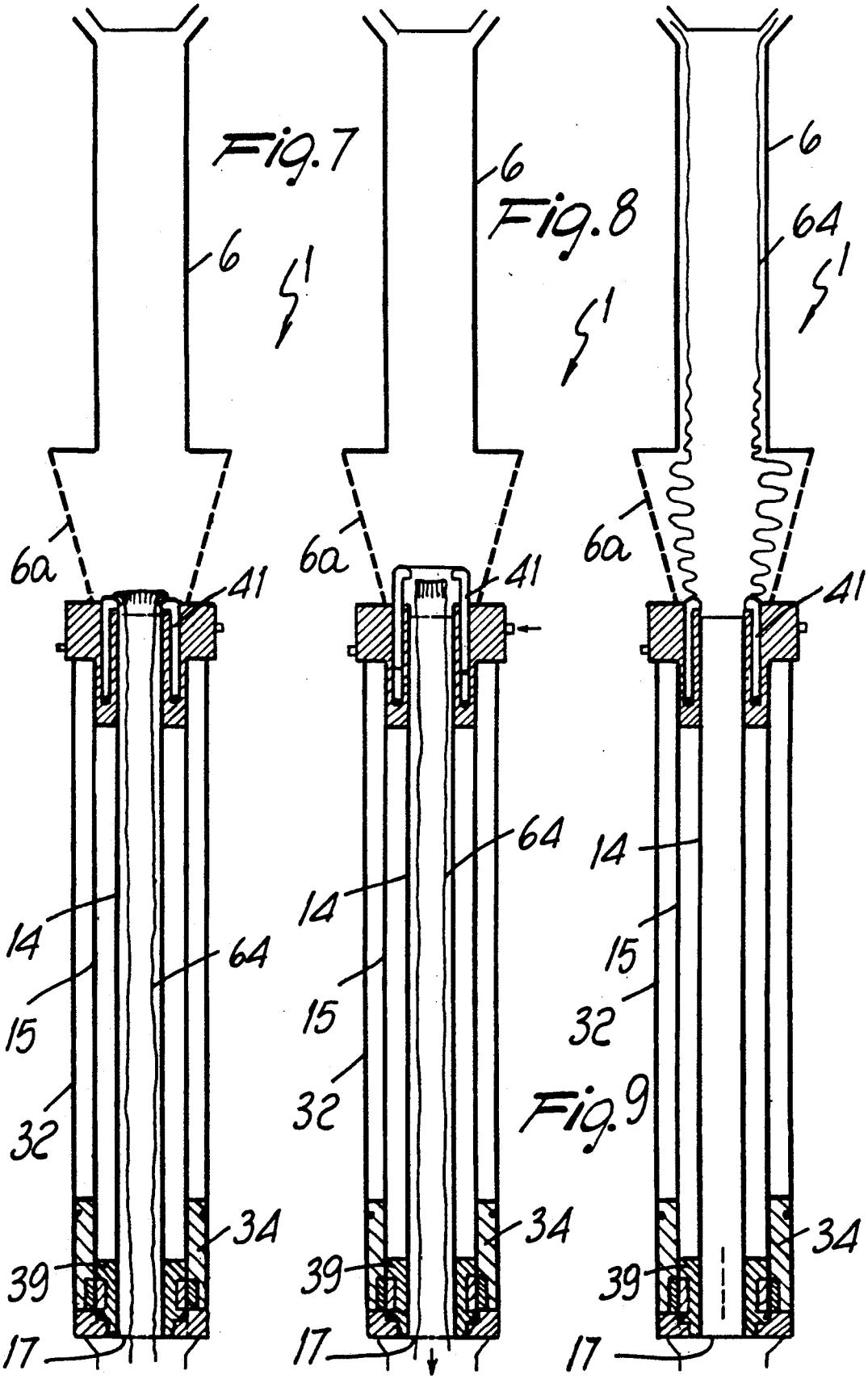
FIG. 9 is a schematic view of the operation of the machine according to the invention when the product does not need to be turned inside out.

At this point, the actuation means 20 are activated which cause the descent of the inner tubular body 14, i.e its progressive passage from the first position to second position (FIGS. 6 and 7). By virtue of the descent of the inner tubular body 14, the drawing of the product 64 along the inner tubular body 14 is facilitated and thus turns the product inside out. It should be noted that by virtue of the fact that the product does not have to rise externally along the inner tubular body 14, as instead occurs in machines with conventional anti-twist devices, the product is turned inside out without problems and with a reduced pneumatic power even in the case of products which tend to adhere to the outer surface of the inner tubular body 14.

When the upper edge of the inner tubular body 14 arrives proximate to the bottom 12, the auxiliary tubular body 41 is actuated so as to move it from the inoperative position to the operative position. In this manner, the upper edge of the auxiliary tubular body 41 moves above the upper edge of the inner tubular body 14, which has arrived proximate to the bottom 12 of the outer tubular body 6, thus completing the transfer of the product inside the inner tubular body 14 (FIG. 8). The intervention of the auxiliary tubular body 41 ensures the passage of the border of the product 64 inside the tubular body 14 even in the case of products having a particularly rigid elastic border.

When the drawing of the product 64 into the tubular body 14 is completed, the inner tubular body 14 is returned to the first position.

It should be noted that when the inner tubular body 14 is in the second position, the drawing through said tubular body even of products whose manufacture has been interrupted, and which therefore may have a reduced length, is ensured.

When the product does not need to be turned inside out, the inner tubular body 14 is simply kept in the second position, without having to perform any disassembly operation. In this manner, the anti-twist device in any case performs its action of subjecting the product to tension and retaining it against the walls of the outer tubular body 6 (FIG. 9).

In practice it has been observed that the machine according to the invention fully achieves the intended aim, since it allows to easily turn the products inside out and to remove them from the machine even in the case of products which tend to adhere to the outer surface of the inner tubular body, or of products having a rigid border which tends to hinder the completion of the passage of the products inside the inner tubular body.

A further advantage is that it does not require the removal of the inner tubular body if the product does not need to be turned inside out.

The machine thus conceived is susceptible to numerous modifications and variations, all of which are within the scope of the inventive concept; thus, for example, even other known devices may be used for the axial translatory motion of the inner tubular body.

All the details may furthermore be replaced with technically equivalent elements.

In practice, the materials employed, as well as the dimensions, may be any according to the requirements and the state of the art.

We claim:

1. Single-cylinder circular machine with anti-twist device, for manufacturing socks and stockings, comprising;

a plurality of needles;

a needle cylinder having an upper end and a needle cylinder axis, said needle cylinder being rotatable about said needle cylinder axis and supporting said plurality of needles proximate to said upper end;

a perforated region extending around said needle cylinder axis and being spaced downward from said upper end of said needle cylinder;

a suction device;

a cavity having an inner wall, said cavity being defined substantially coaxially in said needle cylinder and open at said upper end of said needle cylinder, means for connecting said cavity through said perforated region to said suction device for retaining a product being formed against said inner wall of said cavity;

an inner tubular body having a tubular body upper end and an outer surface, said inner tubular body being accommodated in said cavity substantially coaxially to said needle cylinder and controllably connectable to said suction device for aspirating a finished product through said inner tubular body;

means for controllably axially moving said inner tubular body along said cavity between a first position, whereat said tubular body upper end is proximate to said upper end of said needle cylinder, and a second position, whereat said tubular body upper end is located proximate to said perforated region;

an inner surface defined by said needle cylinder;

an outer tubular body fixed to said inner surface of said needle cylinder and having said cavity defined therein;

a plurality of holes traversing a portion of said outer tubular body spaced downward from said upper end of said needle cylinder and constituting said perforated region;

an annular chamber extending around said perforated region and being controllably connectable to said suction device;

a bottom closing said outer tubular body, and being coaxially traversed by said inner tubular body, and;

auxiliary means for disengaging a finished product from said tubular body upper end when in said second position, wherein said inner tubular body is connected to said outer tubular body in rotation about said needle cylinder axis and axially slideably supported by said bottom, and;

wherein said auxiliary means for disengaging the product comprise an auxiliary tubular body arranged coaxially around said inner tubular body and being axially slideably supported by said bottom of said outer tubular body, said auxiliary tubular body having an upper edge, said upper edge being in sliding contact with said outer surface of said inner tubular body and controllably movable from an inoperative position, whereat said upper edge is located proximate to said bottom of said outer tubular body, to an operative position, whereat said upper edge is located above said upper end of said inner tubular body in said second position in order to aid aspiration of a product into said inner tubular body.

2. Machine according to claim 1, wherein said auxiliary tubular body comprises a hollow piston, said hollow piston being slideable along a chamber, said chamber being defined in said bottom of said outer tubular body and connectable to a source of pressurized fluid for moving said auxiliary tubular body between said inoperative position and said operative position.

3. Machine according to claim 1, further comprising a shoulder defined by said bottom and another shoulder connected to said auxiliary tubular body, wherein said auxiliary tubular body is movable from said inoperative position to said operative position against spring means, said spring means interposed between said shoulder defined by said bottom of said outer tubular body and said other shoulder connected to said auxiliary tubular body.

4. Machine according to claim 1, further comprising controllably activatable actuation means for axially moving said inner tubular body, and wherein said machine has a supporting structure, and said inner tubular body has a lower end, said actuation means comprising:

a pair of hollow cylindrical bodies arranged inside one another and fixed to said supporting structure of said machine coaxially to said needle cylinder, said hollow cylindrical bodies being arranged below said needle cylinder;

a chamber defined between pair of hollow cylindrical bodies and having an annular transverse cross-section;

a perforated piston slideably accommodated in said chamber and movable along said chamber;

an inner hollow cylindrical body defined by said pair of hollow cylindrical bodies;

an annular slider axially slideably accommodated inside said inner hollow cylindrical body and connected to said lower end of said inner tubular body;

magnet means connected to said perforated piston, and;

magnetic means connected to said annular slider and interacting with said magnet means, for magnetically attracting said annular slider to said perforated piston, to axially move said annular slider inside said inner hollow cylindrical body upon an axial movement of said perforated piston.

5. Machine according to claim 4, wherein the inside of said inner hollow cylindrical body is separated from said chamber and connectable to said suction device.

6. Machine according to claim 4, wherein said annular slider is at least partially magnetic, and wherein said perforated piston has magnetic material fixed thereto, said annular slider and said perforated piston being magnetically attracted to each other.

7. Machine according to claim 4, further comprising a source of pressurized fluid, and a discharge, said discharge being located at an opposite side of said perforated piston with respect to said source of pressurized fluid, said chamber being connected to said source of pressurized fluid and to said discharge for moving said perforated piston along said chamber.

8. Machine according to claim 4, further comprising a bearing located between said annular slider and said lower end of said inner tubular body.

9. Machine according to claim 4, wherein said inner tubular body is inside said inner hollow cylindrical body when located at said second position.

10. Machine according to claim 1, further comprising controllably activatable actuation means for axially moving said inner tubular body, said actuation means comprising;

two pulleys;

a flexible element defining a closed-loop configuration and being entrained around said two pulleys;

a hollow cylindrical body arranged below said needle cylinder and being connected to said lower end of said inner tubular body;

an actuation piston;

a double acting fluid-actuated cylinder having a cylindrical chamber;

an actuation piston having a stem and slideably accommodated inside said cylindrical chamber;

a source of pressurized fluid connected to one end of said fluid-actuated cylinder, and;

a discharge connected to another end of said fluid-actuated cylinder and being located at an opposite end of said actuation piston with respect to said source of pressurized fluid;

wherein said flexible element is fixed to said hollow cylindrical body and constitutes said stem of said actuation piston, and said fluid actuated cylinder is connected to said source of pressurized fluid and said discharge for moving said elongated element and said inner tubular element between said first position and said second position.

11. Single-cylinder circular machine with anti-twist device, for manufacturing socks and stockings, comprising;

a plurality of needles;

a needle cylinder having an upper end and a needle cylinder axis, said needle cylinder being rotatable about said needle cylinder axis and supporting said plurality of needles proximate to said upper end;

a perforated region extending around said needle cylinder axis and being spaced downward from said upper end of said needle cylinder;

a suction device;

a cavity having an inner wall, said cavity being defined substantially coaxially in said needle cylinder and open at said upper end of said needle cylinder, means for connecting said cavity through said perforated region to said suction device for retaining a product being formed against said inner wall of said cavity;

an inner tubular body having a tubular body upper end and an outer surface, said inner tubular body being accommodated in said cavity substantially coaxially to said needle cylinder and controllably connectable to said suction device for aspirating a finished product through said inner tubular body;

means for controllably axially moving said inner tubular body along said cavity between a first position, whereat said tubular body upper end is proximate to said upper end of said needle cylinder, and a second position, whereat said tubular body upper end is located proximate to said perforated region, whereby selective positioning of said tubular body in said second position permits aspiration of a knitted product into said inner tubular body without turning the knitted product inside out.

12. Machine according to claim 11, further comprising;

an inner surface defined by said needle cylinder;

an outer tubular body fixed to said inner surface of said needle cylinder and having said cavity defined therein;

a plurality of holes traversing a portion of said outer tubular body spaced downward from said upper end of said needle cylinder and constituting said perforated region;

an annular chamber extending around said perforated region and being controllably connectable to said suction device;

a bottom closing said outer tubular body and being coaxially traversed by said inner tubular body, and;

auxiliary means for disengaging a finished product from said tubular body upper end when in said second position.

13. Single-cylinder circular machine with anti-twist device, for manufacturing socks and stockings, comprising;

a plurality of needles;

a needle cylinder having an upper end and a needle cylinder axis, said needle cylinder being rotatable about said needle cylinder axis and supporting said plurality of needles proximate to said upper end;

a perforated region extending around said needle cylinder axis and being spaced downward from said upper end of said needle cylinder;

a suction device;

a cavity having an inner wall, said cavity being defined substantially coaxially in said needle cylinder and being open at said upper end of said needle cylinder, said cavity being connectable through said perforated region to said suction device for retaining a product being formed against said inner wall of said cavity;

an inner tubular body having a tubular body upper end and an outer surface, said inner tubular body being accommodated in said cavity substantially coaxially to said needle cylinder and being controllably connectable to said suction device for aspirating a finished product through said inner tubular body;

means for controllably axially moving said inner tubular body along said cavity between a first position, whereat said tubular body upper end is proximate to said upper end of said needle cylinder, and a second position, whereat said tubular body upper end is proximate to a lower end of said perforated region, whereby selective positioning of said tubular body in said second position permits aspiration of a knitted product into said inner tubular body without turning the knitted product inside out;

said machine further comprising;

an inner surface defined by said needle cylinder;

an outer tubular body fixed to said inner surface of said needle cylinder and having said cavity defined therein;

a plurality of holes traversing a portion of said outer tubular body spaced downward from said upper end of said needle cylinder and constituting said perforated region;

an annular chamber extending around said perforated region and being controllably connectable to said suction device;

a bottom closing said outer tubular body and being coaxially traversed by said inner tubular body, and;

auxiliary means for disengaging a finished product from said tubular body upper end when in said second position.

wherein said inner tubular body is connected to said outer tubular body in rotation about said needle cylinder axis and axially slideably supported by said bottom, and;

wherein said auxiliary means for disengaging the product comprise an auxiliary tubular body arranged coaxially around said inner tubular body and being axially slideably supported by said bottom of said outer tubular body, said auxiliary tubular body having an upper edge, said upper edge being in sliding contact with said outer surface of said inner tubular body and controllably movable from an inoperative position, whereat said upper edge is arranged proximate to said bottom of said outer tubular body, to an operative position, whereat said upper edge is arranged above said upper end of said inner tubular body in said second position in order to aid aspiration of a product into said inner tubular body.

14. Single-cylinder circular machine with anti-twist device, for manufacturing socks and stockings, comprising;

a supporting structure;

a plurality of needles;

an internally hollow needle cylinder having an inner surface and supporting said plurality of needles, said needle cylinder having a needle cylinder axis and an upper end and being rotatably supported by said supporting structure;

an outer tubular body having a lower end, said outer tubular body being connected to said inner surface of said needle cylinder and being coaxial therewith;

a cavity defined within said outer tubular body;

an enlarged perforated portion defined by said tubular body below said needle cylinder;

a bottom closing said lower end of said outer tubular body;

a seat formed in said bottom;

an inner tubular body lying coaxial to said outer tubular body and being slideably accommodated in said seat, said inner tubular body having a tubular body upper end and being accommodated in said cavity substantially coaxially to said needle cylinder, said inner tubular body being controllably connectable to a suction device for aspirating a finished product through said inner tubular body; and actuation means for controllably axially moving said inner tubular body along said cavity between a first position, whereat said tubular body upper end is proximate to said upper end of said needle cylinder, and a second position, whereat said tubular body upper end is located proximate to said perforated region, whereby movement of said inner tubular body from said first position to said second position permits aspiration of a knitted product into said inner tubular body and simultaneously turning said knitted product inside out, and whereby selective positioning of said tubular body in said second position permits aspiration of a knitted product into said inner tubular body without turning the knitted product inside out.

15. Machine according to claim 14, wherein said enlarged perforated portion comprises a frustum-shaped portion traversed by a plurality of holes.

* * * * *